US006575388B2

(12) United States Patent
Aota et al.

(10) Patent No.: US 6,575,388 B2
(45) Date of Patent: Jun. 10, 2003

(54) FUEL INJECTION VALVE

(75) Inventors: Masayuki Aota, Tokyo (JP); Norihisa Fukutomi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/858,716

(22) Filed: May 17, 2001

(65) Prior Publication Data

US 2002/0066804 A1 Jun. 6, 2002

(30) Foreign Application Priority Data

Dec. 1, 2000 (JP) ..... 2000-366720

(51) Int. Cl.[7] ..... F02M 61/10

(52) U.S. Cl. ..... 239/533.12; 239/533.3; 239/533.11; 239/585.1; 239/585.5; 251/50

(58) Field of Search ..... 239/533.3, 533.11, 239/533.12, 585.1, 585.4, 585.5; 251/48, 50, 53

(56) References Cited

U.S. PATENT DOCUMENTS 4,911,366 A * 3/1990 Priesner ..... 239/533.3
5,271,565 A * 12/1993 Cerny ..... 251/50
5,288,025 A * 2/1994 Cerny ..... 251/50
5,524,826 A * 6/1996 Mueller et al. ..... 239/585.1
5,871,157 A 2/1999 Fukutomi et al.
6,035,532 A * 3/2000 Earnhardt ..... 29/888.44
6,318,646 B1 * 11/2001 Mattioli et al. ..... 239/585.1

FOREIGN PATENT DOCUMENTS

JP 59-190472 10/1984
JP 9-273457 10/1997

* cited by examiner

*Primary Examiner*—Steven J. Ganey
(74) *Attorney, Agent, or Firm*—Sughrue Mion, PLLC

(57) ABSTRACT

There is provided a fuel injection valve in which an operation sound at the time of an operation of the fuel injection valve is lowered, and durability of parts is improved. A flat surface 4*a* of a valve body 4 is provided at a lower surface side of a shoulder portion 3*a* provided at a needle valve 3, and when the needle valve 3 moves in a valve closing direction, a portion B in which fuel is confined is compressed at a place between a lower surface of the shoulder portion 3*a* and the flat surface 4*a*, so that a damping effect of fluid is obtained and an operation sound is lowered.

3 Claims, 7 Drawing Sheets

PRIOR ART

FUEL INJECTION VALVE

BACKGROUND OF THE INVENTION

1. Field of the Invention

The present invention relates to a fuel injection valve of a type in which fuel is injected by opening and closing a needle valve.

2. Description of the Related Art

FIG. 7 is a sectional view showing a conventional fuel injection valve. In the drawing, reference numeral 11 designates a coil; 12, an armature; 13, a core; 14, a needle valve; 15, a valve seat; and 16, a spring.

Its operation will next be explained. When current is applied to the coil 11, the armature 12 is attracted toward the side of the core 13, the needle valve 14 provided integrally with the armature 12 is separated from the valve seat 15, and fuel is injected from a gap between the valve seat 15 and the needle valve 14. When current application to the coil 11 is cut off, the needle valve 14 is pressed to the side of the valve seat 15 by the spring 16, and the needle valve 14 comes into contact with the valve seat 15. The amount of fuel injection is controlled by opening and closing of this needle valve 14.

Since the conventional fuel injection valve is constructed as described above, there have been such problems that a shock is generated when the needle valve comes to be seated on the valve seat, and this results in an operation sound of the fuel injection valve, and becomes a factor of deterioration in durability since the needle valve and the valve seat are worn down.

Incidentally, it is needless to say that it is appropriate that the shock at the time when the needle valve comes to be seated on the valve seat is as low as possible.

SUMMARY OF THE INVENTION

The present invention has been made to solve the problems as set forth above, and has an object to provide a fuel injection valve in which a shock at the time of seating of a needle valve is made low so that an operation sound is lowered, and durability of a valve seat and a needle valve is raised.

According to the present invention, a fuel injection valve includes a hollow valve body, a valve seat provided at one end of the valve body and having an injection hole, and a needle valve moving in the valve body and coming in contact with and separating from the valve seat to open and close the injection hole, in which a shoulder portion is provided at the needle valve, and a ring is provided at a lower surface side of the shoulder portion, so that a portion for confining fuel is formed between a lower end surface of the shoulder portion and an upper end surface of the ring.

Thus, the operation sound is lowered, the durability can be improved, and the adjustment of fluid damping effect becomes possible.

DETAILED DESCRIPTION OF THE PREFERRED EMBODIMENTS

Embodiment 1

Figure 1:
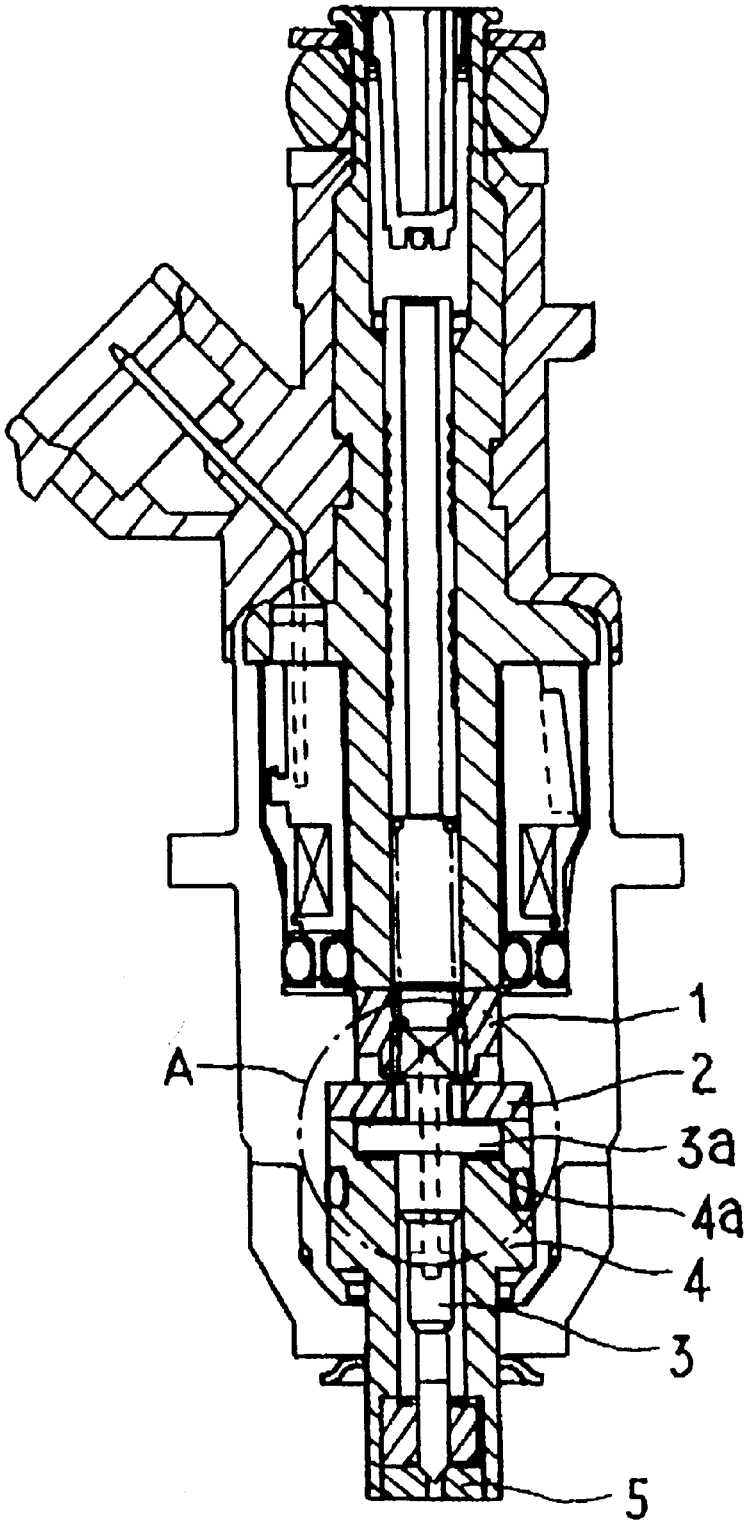
FIG. 1 is a sectional view showing a fuel injection valve according to embodiment 1 of the present invention.
Figure 2:
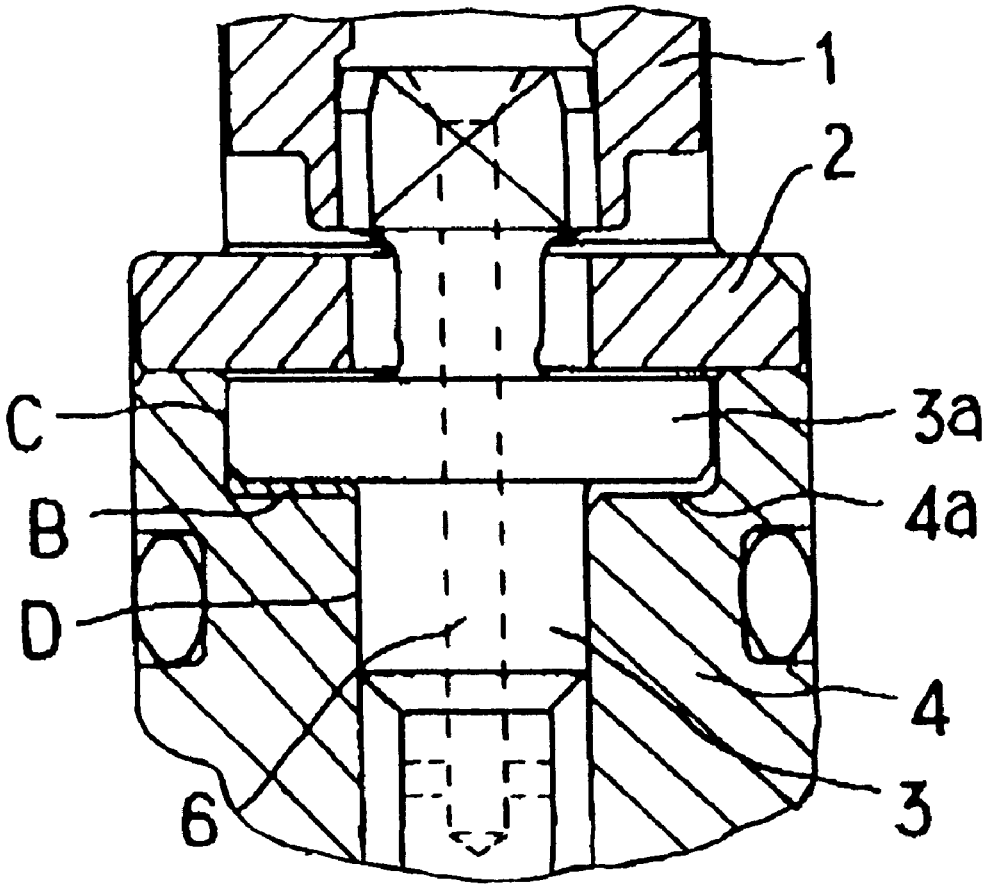
FIG. 2 is an enlarged view of portion A of FIG. 1.

Hereinafter, embodiments of the present invention will be described with reference to the drawings. FIG. 1 is a sectional view showing a fuel injection valve according to embodiment 1 of the present invention, and FIG. 2 is an enlarged view of a portion A of FIG. 1.

In the drawings, reference numeral 1 designates an armature; 2, a stopper; 3, a needle valve; 3*a,* a shoulder portion provided at the needle valve 3; 4, a valve body; 4*a,* a flat surface of the valve body 4; 5, a valve seat having an injection hole; and 6, a fuel passage.

In this embodiment, the flat surface 4*a* of the valve body 4 is provided at a lower surface side of the shoulder portion 3*a* provided at the needle valve 3. By doing so, when the needle valve 3 moves in a valve closing direction, a portion B in which fuel is confined is compressed at a place between the lower surface of the shoulder portion 3*a* of the needle valve 3 and the flat surface 4*a* of the valve body 4, so that a damping effect of fluid is obtained, and it becomes possible to slow down a valve closing speed of the needle valve 3.

Particularly, as the needle valve 3 moves further in the valve closing direction, the size of a gap between the lower surface of the shoulder portion 3*a* of the needle valve and the flat surface 4*a* of the valve body becomes small and the damping effect becomes high, so that the maximum damping effect is obtained immediately before the valve is closed, and a great effect in the reduction of operation sound and the improvement of durability can be obtained.

Incidentally, in this structure, as a sectional area of a flow passage portion through which fuel confined between the lower surface of the shoulder portion 3*a* of the needle valve and the flat surface 4*a* of the valve body escapes is made small, a higher damping effect can be obtained. Accordingly, it is appropriate that the size of a gap between the needle valve 3 and the valve body 4 at a portion C and a portion D of FIG. 2 is made as small as possible.

Thus, since it is necessary to separately secure a flow passage through which fuel flows from an upstream side of the shoulder portion 3*a* of the needle valve to a downstream side, in this embodiment, the fuel passage 6 is provided in an inner diameter portion of the needle valve.

Besides, at the shoulder portion 3*a* of the needle portion 3*a,* its upper surface side constitutes a contact surface to the stopper 2.

By providing the structure as described above, the operation sound can be lowered and the durability can be improved.

Figure 3:
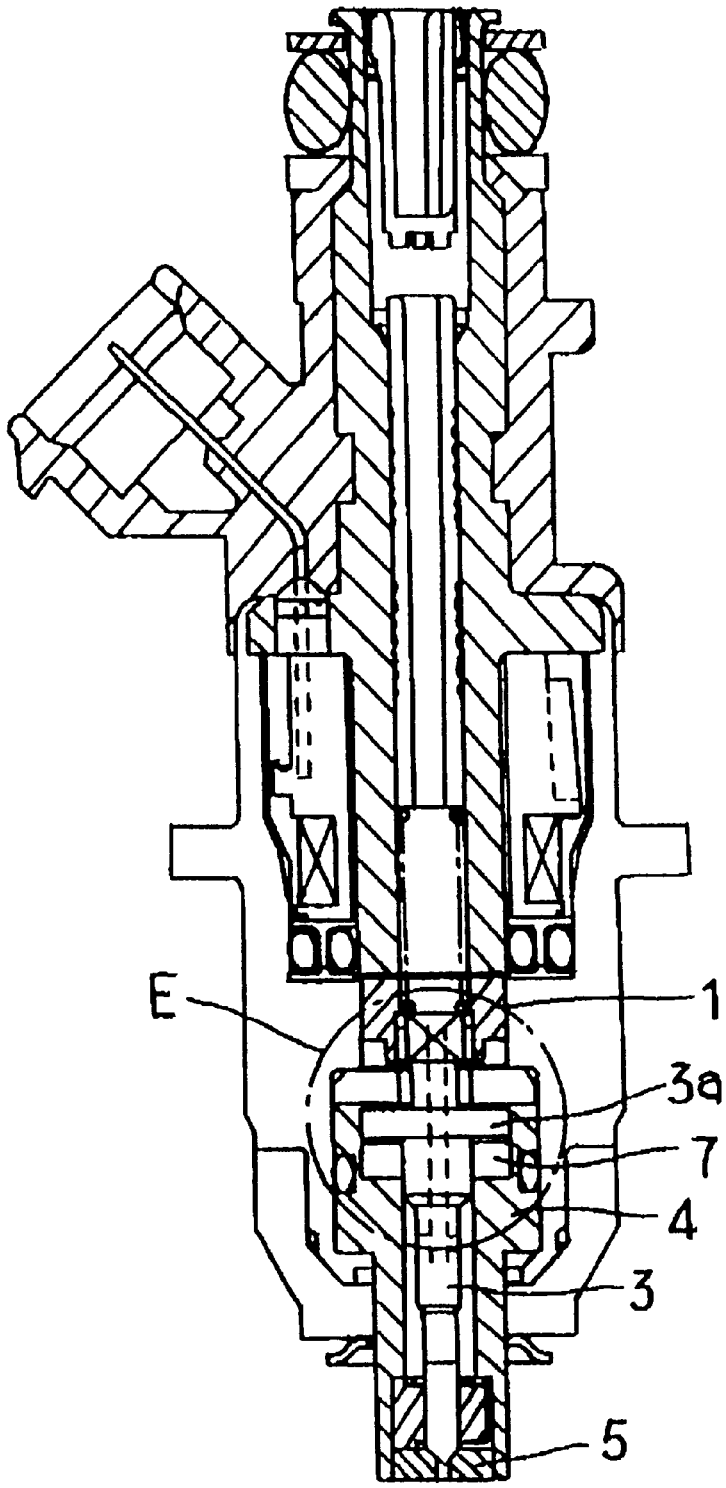
FIG. 3 is a sectional view showing a fuel injection valve according to another embodiment of the present invention.

FIG. 3 is a sectional view showing a fuel injection valve according to another embodiment. In this embodiment, a ring 7 as a member different from a valve body 4 is provided at a position opposite to a lower end surface of a shoulder portion 3*a* of a needle valve.

This embodiment is designed such that fuel is confined in a portion between the lower end surface of the shoulder portion 3*a* of the needle valve and the upper end surface of the ring 7, so that the damping effect of fluid is obtained.

Since the volume of fuel to be confined can be adjusted by adjusting the thickness of the ring 7, the fluid damping effect can be adjusted by merely providing plural kinds of rings 7 having different thicknesses in advance, and selecting and combining the ring 7 having a suitable thickness in accordance with the size of the valve body 4 and the needle valve 3, and simple manufacture becomes possible while fluctuation in performance is made low.

Figure 4:
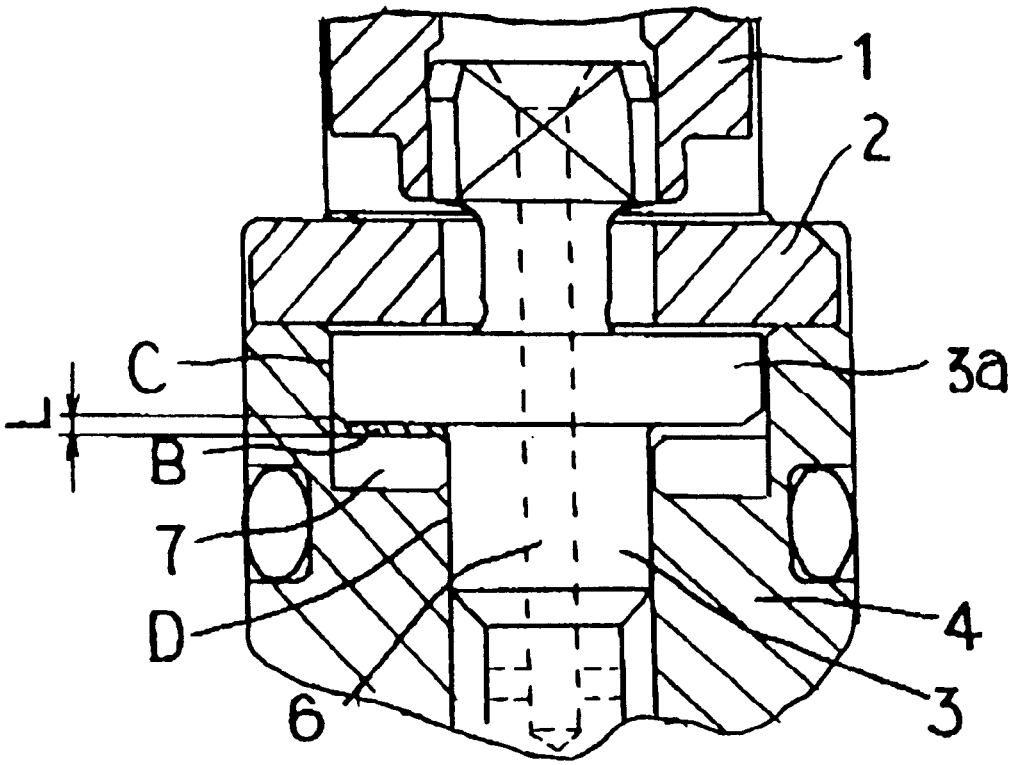
FIG. 4 is an enlarged view of a portion E of FIG. 3.

FIG. 4 is an enlarged view of a portion E of FIG. 3.

In the present invention, a damping effect of fuel is determined by a size L in FIG. 4. As the size L becomes small, a high damping effect can be obtained. Thus, by making the size L as small as possible and decreasing the fluctuation, it is possible to suppress the fluctuation of performance while the damping effect of fluid is sufficiently obtained.

Then, when the ring 7 is used and the ring 7 of a suitable thickness is combined so that the desired size L is obtained even if the fluctuation of the size of the needle valve 3 and the valve body 4 occurs, it becomes possible to suppress the fluctuation of the size L of each product to be small.

Specifically, plural kinds of rings 7 having different thicknesses are prepared, and the ring 7 of a suitable thickness is selected and combined in accordance with the size of the needle valve 3 and the valve body 4.

Figure 5:
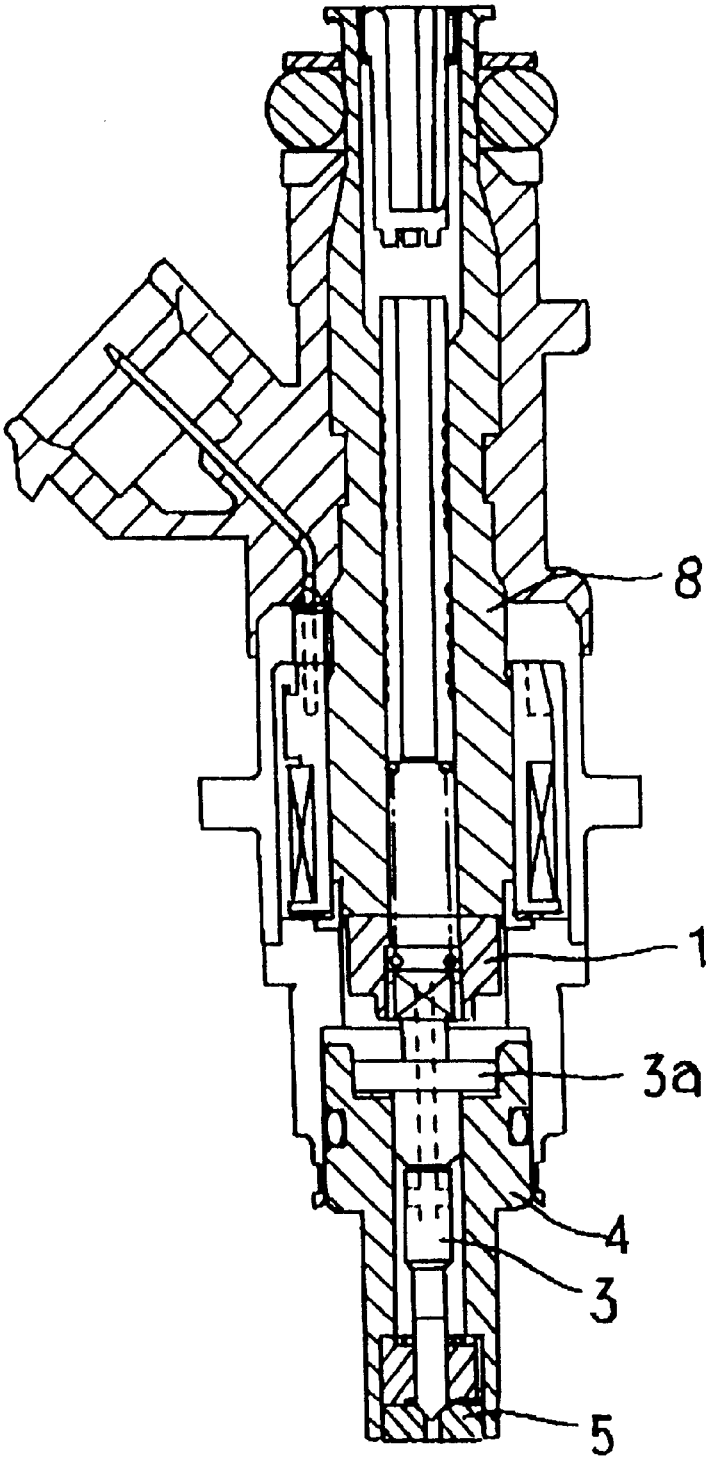
FIG. 5 is a fuel injection valve according to another embodiment of the present invention.

FIG. 5 is a sectional view showing a fuel injection valve according to another embodiment. In this embodiment, such a structure is adopted that a stopper is omitted, and when a needle valve 3 is opened, an upper end surface of an armature 1 comes in contact with a lower end surface of a core 8. Even in the structure like this, the damping effect similar to the above embodiments can be obtained by providing a shoulder portion 3*a* to the needle valve 3.

Embodiment 2

Figure 6:
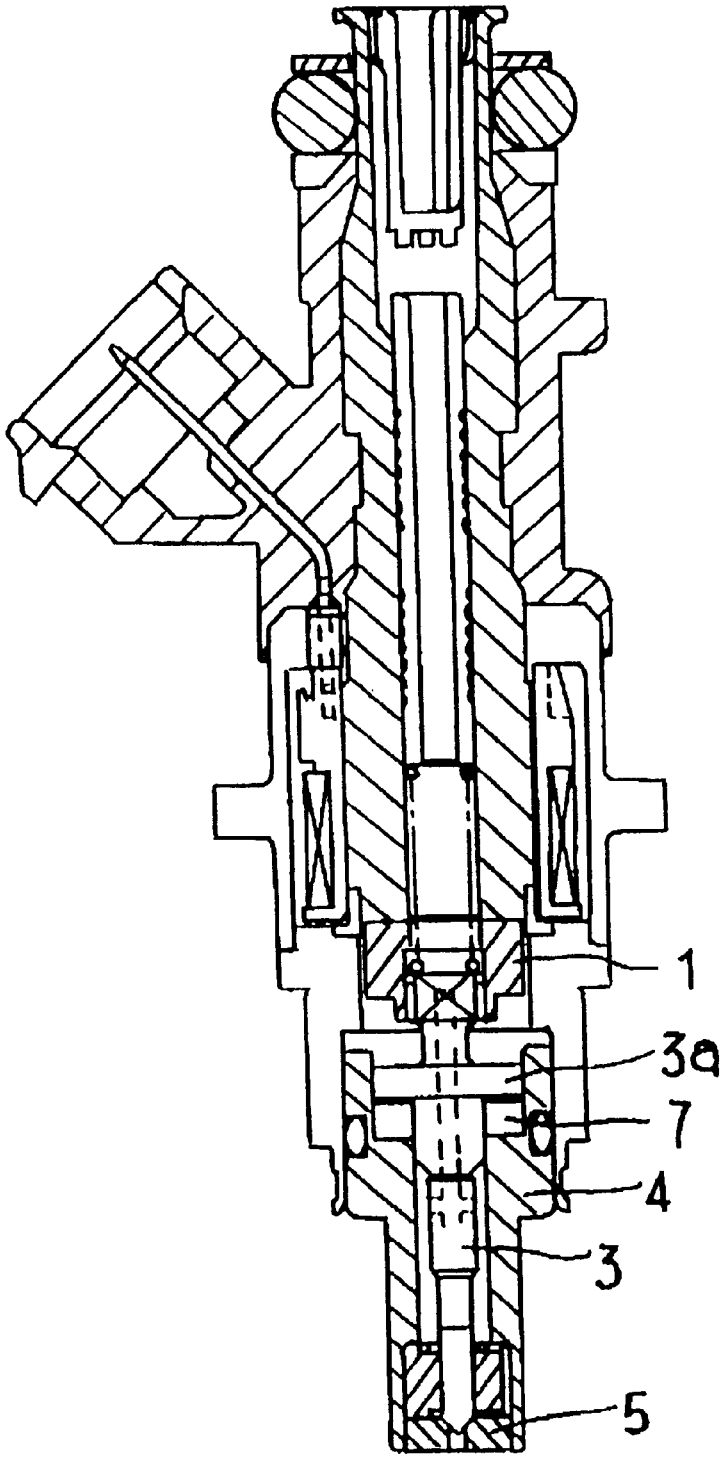
FIG. 6 is a fuel injection valve according to embodiment 2 of the present invention.
Figure 7:
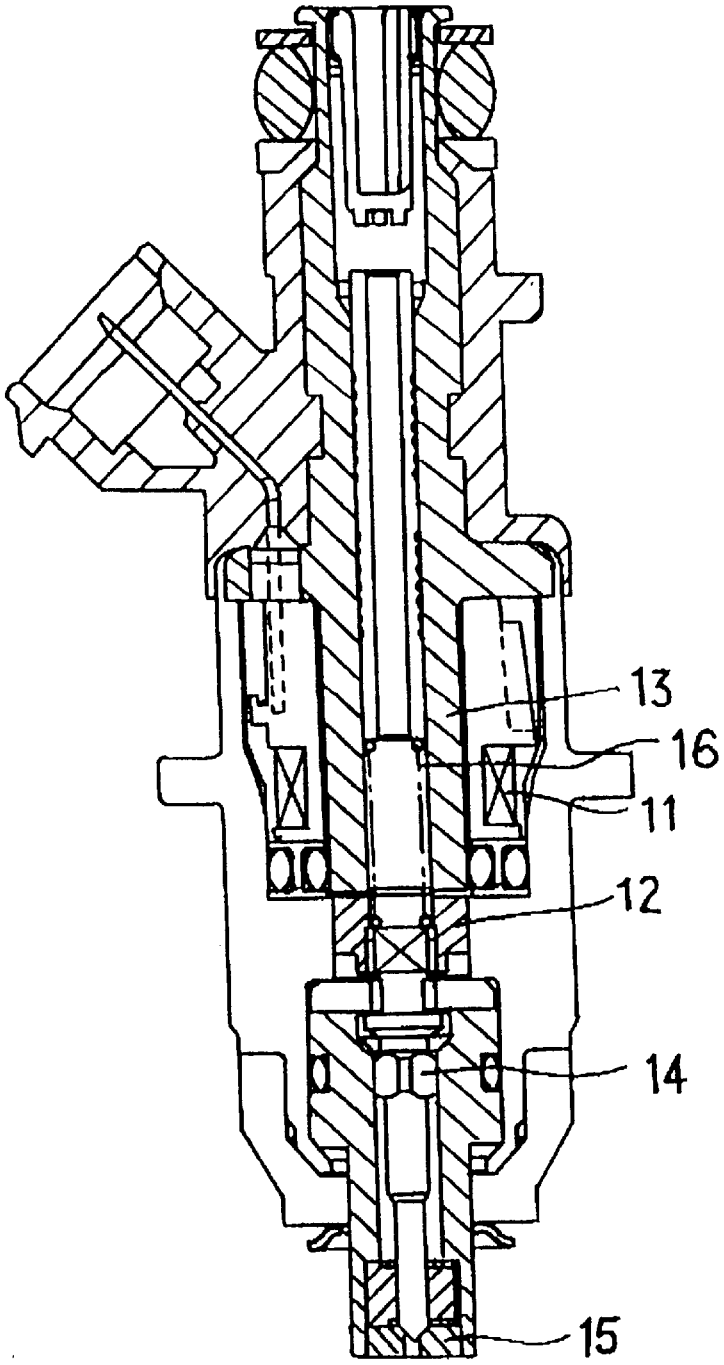
FIG. 7 is a sectional view showing a conventional fuel injection valve.

FIG. 6 is a sectional view showing a fuel injection valve according to embodiment 2 of the present invention. Also in this embodiment, a stopper is omitted similarly to the above, and further, a ring 7 as a member different from a valve body 4 is provided at a position opposite to a lower end surface of a shoulder portion 3*a* of a needle valve.

This embodiment 2 has such effects that, similarly to the embodiment 1, performance is stabilized and manufacture becomes easy.

What is claimed is:

1. A fuel injection valve, comprising:

a hollow valve body;

a valve seat provided at a downstream end of the valve body and having an injection hole; and a needle valve moving in the hollow valve body and coming in contact with and separating from the valve seat to open and close the injection hole;

a shoulder portion provided at the needle valve, wherein the shoulder portion has a downstream end surface; and a ring provided at a downstream side of the shoulder portion, wherein the ring has an upstream end surface;

wherein the shoulder portion is sealingly seated in the hollow valve body to restrict leakage between the shoulder portion and the hollow valve body;

wherein a confining portion for confining fuel is formed within the hollow valve body between the downstream end surface of the shoulder portion, the upstream end surface of the ring, and the needle valve; and wherein at least a portion of the needle valve is sealingly seated in at least one of an inner diameter of the ring or an inner diameter of the hollow valve body to restrict leakage between the needle valve and the inner diameter of the ring, or the needle valve and the inner diameter of the hollow valve body, respectively.

2. The fuel injection valve of claim 1, further comprising a fuel passage formed in an inner diameter of the needle valve and communicating with an upstream side of the shoulder portion and a downstream side of the ring, wherein the fuel passage is isolated from the confining portion.

3. The fuel injection valve of claim 1, further comprising a stopper disposed on an upstream side of the shoulder portion, wherein the stopper has a downstream end surface that restricts upstream movement of the shoulder portion.

* * * * *